US005219703A

United States Patent [19]

Bugner et al.

[11] Patent Number: 5,219,703

[45] Date of Patent: Jun. 15, 1993

[54] LASER-INDUCED THERMAL DYE TRANSFER WITH BLEACHABLE NEAR-INFRARED ABSORBING SENSITIZERS

[75] Inventors: Douglas E. Bugner; William Mey, both of Rochester, N.Y.

[73] Assignee: Eastman Kodak Company, Rochester, N.Y.

[21] Appl. No.: 833,265

[22] Filed: Feb. 10, 1992

[51] Int. Cl.[5] ..... G03C 8/10; G03C 8/24

[52] U.S. Cl. ..... 430/200; 430/201; 430/944; 430/945; 430/339; 346/76 L; 428/195; 503/227

[58] Field of Search ..... 430/200, 201, 944, 945, 430/199, 339; 503/227; 346/76 L; 428/195

[56] References Cited

U.S. PATENT DOCUMENTS

| | | | |
|---|---|---|---|
| 3,485,630 | 12/1969 | Burgess et al. | 430/297 |
| 3,925,077 | 12/1975 | Lewis et al. | 430/2 |
| 4,447,521 | 5/1984 | Tiers et al. | 430/337 |
| 4,515,877 | 5/1985 | Barzynski et al. | 430/5 |
| 4,575,479 | 3/1986 | Nagamoto et al. | 430/159 |
| 4,632,895 | 12/1986 | Patel et al. | 430/201 |
| 4,701,402 | 10/1987 | Patel et al. | 430/332 |
| 4,705,729 | 11/1987 | Sheats | 430/5 |
| 4,769,459 | 9/1988 | Patel et al. | 544/301 |
| 4,912,083 | 3/1990 | Chapman et al. | 503/227 |
| 4,924,009 | 5/1990 | Neckers et al. | 549/223 |
| 4,950,640 | 8/1990 | Evans et al. | 503/227 |
| 4,973,572 | 11/1990 | DeBoer | 503/227 |
| 5,034,303 | 7/1991 | Evans et al. | 430/200 |

FOREIGN PATENT DOCUMENTS 88306445.3 7/1988 European Pat. Off. .

*Primary Examiner*—Charles L. Bowers, Jr.
*Assistant Examiner*—John A. McPherson
*Attorney, Agent, or Firm*—Michael L. Goldman; William T. French; Willard G. Montgomery

[57] ABSTRACT

The present invention relates to laser-induced thermal dye transfer using heat-transferable dyes, bleachable and heat-transferable near-infrared absorbing sensitizers, acid-photogenerating compounds, and optional near-ultraviolet absorbing sensitizers. The combination of the near-infrared absorbing sensitizer and acid-photogenerating compounds effects transfer of the heat-transferable dyes and bleaching of the near-infrared absorbing sensitizer to eliminate unwanted visible light absorption. The acid-photogenerating compound may be present in either the dye-donor or dye-receiver element. If the acid-photogenerator is in the dye-donor, bleaching will occur upon initial exposure of the dye-donor to near-infrared or near-ultraviolet radiation. If present in the dye-receiver element, bleaching will occur upon subsequent exposure of the dye receiver to near-infrared or near-ultraviolet radiation.

17 Claims, No Drawings

LASER-INDUCED THERMAL DYE TRANSFER WITH BLEACHABLE NEAR-INFRARED ABSORBING SENSITIZERS

FIELD OF THE INVENTION

This invention relates to laser-induced thermal dye transfer using elements containing bleachable compositions comprising near-infrared radiation absorbing sensitizers and acid-photogenerating compounds. Near-infrared radiation absorbing sensitizers are used to volatilize heat-transferable dyes and effect image formation and transfer. The near-infrared radiation absorbing sensitizer is bleached when in combination with an acid-photogenerating compound and exposed with either near-infrared or near-ultraviolet radiation to remove unwanted visible light absorptions.

BACKGROUND OF THE INVENTION

Thermal dye transfer systems have been used to obtain prints electronically-generated by color video cameras.

Such prints can be produced by first subjecting an electronic picture to color separation with color filters. The respective color-separated images are converted to electrical signals and then processed to produce cyan, magenta and yellow electrical signals which are transmitted to a thermal printer. To obtain the print, a cyan, magenta or yellow dye-donor element is placed face-to-face with a dye-receiver element, with both elements being between a thermal printing head and a platen roller. The thermal printing head has many heating elements that are heated up sequentially in response to the cyan, magenta and yellow signals to transfer donor sheet dye to the receiver sheet. The process is repeated for the other two colors, and a color hard copy is obtained which corresponds to the original picture viewed on a screen. Further details of this process and an apparatus for carrying it out are contained in U.S. Pat. No. 4,621,271 to Brownstein.

Thermal dye transfer processes have also utilized a laser diode instead of a thermal printing head. This type of imaging process is also known as laser thermal dye transfer ("LTDT"). In such systems, the dye-donor element sheet also contains a near-infrared radiation absorbing material. The dye-donor element is irradiated with a near-infrared laser diode, and the near-infrared absorbing material converts the light energy to thermal energy. As a result, the dye is heated to volatilization and transferred to the receiver. The radiation absorbing material may be present in a layer beneath the dye or admixed with the dye. The laser beam is modulated by electronic signals which are representative of the shape and color of the original image, so that each dye volatilizes only where it is required on the receiver to reconstruct the original image. Further details of this process are found in GB 2,083,726A, the disclosure of which is hereby incorporated by reference.

In GB 2,083,726A, carbon is disclosed as the absorbing material for use in a LTDT system. However, carbon tends to clump when coated which may degrade the transferred dye image. Additionally, carbon may transfer to the receiver by sticking or ablation, producing a mottled or desaturated color image.

Other types of non-carbon, infrared absorbing materials have also been disclosed for laser systems. However, most of these materials also absorb light in the visible region of the electromagnetic spectrum. If the near-infrared absorbing sensitizer absorbs visible light and also migrates with the desired colorants upon heating, then the unwanted visible light absorptions will change the hue and/or color density of the resultant image. U.S. Pat. No. 4,912,083 to Chapman et al. discloses an example of such an absorbing material.

Because most of the available near-infrared absorbing sensitizers are heat-transferable and absorb visible radiation, there is a need for compositions that both absorb strongly in the near-infrared region of the electromagnetic spectrum and are also "bleachable". Bleachable near-infrared absorbers are those compounds whose visible light absorption may be significantly reduced or, preferably, eliminated.

It is known that certain dyes, when combined with certain "acid-photogenerating" compounds, will bleach when exposed to appropriate activating radiation. For instance, in U.S. Pat. No. 4,769,459 to Patel, et al. the combination of a bleachable dye in reactive association with an iodonium ion is disclosed as the image-forming component in an oxidative imaging process.

U.S. Pat. No. 4,632,895 to Patel discloses the combination of a bleachable dye and an iodonium ion as the image-forming component of a diffusion/sublimation imaging system. Patel discloses the use of a variety of exposure sources to effect bleaching for the purpose of image creation. However, in all embodiments, Patel requires an additional step to actually transfer the image. In Patel, the image is first formed, by bleaching, on the dye-donor element and then heated or diffused with a liquid medium onto the image-receiving layer.

SUMMARY OF THE INVENTION

This invention relates to laser-induced thermal dye transfer elements containing bleachable, near-infrared absorbing sensitizers and acid-photogenerating compounds. The near-infrared absorbing sensitizer absorbs near-infrared radiation and converts it to heat which vaporizes dyes present in the dye-donor element. These vaporized dyes are thereby transferred to a dye-receiver element. The near-infrared absorbing sensitizer, which often absorbs visible light that may affect the hue of the transferred dye image, is bleached if combined with an acid-photogenerating compound when exposed to either near-infrared or near-ultraviolet radiation. For purposes of this invention, near-infrared radiation is defined to have a wavelength between about 700 and 1000 nm. Near-ultraviolet radiation is defined to have a wavelength between about 250 and 400 nm.

In one embodiment of the present invention, the acid-photogenerating compound is present in the dye-donor element. Bleaching will occur upon exposure of the dye-donor element to the near-infrared radiation used to transfer the image-forming dyes to the dye-receiver.

Alternatively, the acid-photogenerator may be present in the dye-receiver element. In this embodiment, the near-infrared absorbing sensitizer is bleached by exposing the dye-receiver element to near-infrared or near-ultraviolet radiation after dye transfer has occurred.

Most of the available near-infrared absorbing sensitizers also absorb visible light to some extent. The present invention constitutes a significant improvement over the prior art, because it avoids such unwanted visible light absorptions.

The elements and methods of the present invention also may be used to bleach unwanted visible absorptions after the transfer of the laser-induced thermal dye image to the receiver sheet. This avoids the need for addition of extra components to the dye-donor element and potential incompatibility problems.

DETAILED DESCRIPTION OF THE INVENTION

As noted above, this invention relates to improved methods and elements for performing laser-induced thermal dye transfer. The combination of a bleachable, near-infrared radiation absorbing sensitizer and an acid-photogenerating compound is utilized to effect thermal transfer of a dye image and also to eliminate unwanted visible absorptions by the near-infrared sensitizer. The acid-photogenerating compound may be present either in the dye-donor element or in the dye-receiver element. If present in the dye-donor element, bleaching will occur upon the initial exposure of the dye-donor element to near-infrared or near-ultraviolet radiation.

If the acid-photogenerator is present in the dye-receiver element, bleaching will occur after dye transfer, upon a subsequent exposure to near-infrared or near-ultraviolet radiation.

The elements of the present invention comprise an assemblage of a dye-donor element and a dye-receiver element suitable for thermal transfer of a dyed image. The dye-donor element comprises a dye layer coated on a support in association with a near-infrared radiation absorbing sensitizer which is different from the dye. The near-infrared sensitizer may either be incorporated directly into the dye layer or be present as a separate, adjacent layer to the dye layer. Preferably, the acid-photogenerating compound used to effect bleaching of the near-infrared sensitizer is also present in the dye-donor element with the near infrared sensitizer. However, the acid-photogenerating compound may be placed in the dye-receiver element where it is later combined with the near-infrared sensitizer and exposed to bleach the sensitizer, if this is advantageous relative to the compatibilities of the various compounds used.

Suitable near-infrared absorbing sensitizers are those which do not react with or get bleached by the acid-photogenerating compound until they are exposed to activating radiation. Examples of useful near-infrared absorbing sensitizers include nitroso compounds or a metal complex salt thereof, methine compounds, cyanine compounds, merocyanine compounds, complex cyanine compounds, complex merocyanine compounds, allopolar cyanine compounds, styryl compounds, hemioxonol compounds, squaryllium compounds, thiol metal complex salts (including nickel, cobalt, platinum, palladium complex salts), phthalocyanine compounds (including naphthalocyanine compounds), triallylmethane compounds, triphenylmethane compounds, iminium compounds, diiminium compounds, naphthoquinone compounds, and anthroquinone compounds.

Preferred near-infrared sensitizers include those of the cyanine class. Particularly useful cyanine compounds include 3,3'-diethylthiatricarbocyanine iodide (DTTC) and 1,1'-diethyl-4,4'-carbocyanine iodide (cryptocyanine).

The near-infrared absorbing sensitizer should be present in a concentration sufficient to strongly absorb the activating radiation. The concentration of the near-infrared sensitizer will vary depending upon the near-infrared sensitizer used, the thickness of the layer, and the type of acid-photogenerating compound used. Generally, the concentration of the near-infrared sensitizer will be in the range of 0.01 to 10 percent by weight of the dye-donor element, not including the support.

Although generally, any compound which generates an acid upon near-infrared radiation exposure may be useful, if the acid-photogenerating compound is to be used in the dye-donor element, it should be selected to leave the near-infrared sensitizer unbleached until the element is exposed to activating radiation. Additionally, the acid-photogenerating compound should not absorb strongly in the visible region of the spectrum unless this absorption does not effect bleaching of the near-infrared sensitizer. Although there are many known acid photogenerators useful with ultraviolet and visible radiation, the utility of their exposure with near-infrared radiation is unpredictable. Potentially useful aromatic onium salt acid photogenerators are disclosed in U.S. Pat. Nos. 4,661,429, 4,081,276, 4,529,490, 4,216,288, 4,058,401, 4,069,055, 3,981,897, and 2,807,648 which are hereby incorporated by reference. Such aromatic onium salts include Group Va, Group VIa, and Group VIIa elements. The ability of triarylselenonium salts and triarylsulfonium salts to produce protons upon exposure to ultraviolet and visible light is also described in detail in "UV Curing, Science and Technology", Technology Marketing Corporation, Publishing Division, 1978.

A representative portion of useful Group Va onium salts are:

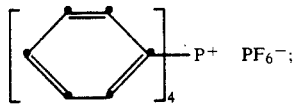

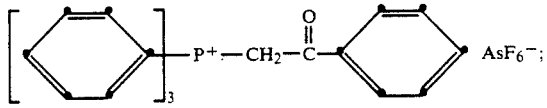

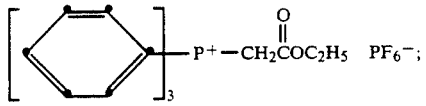

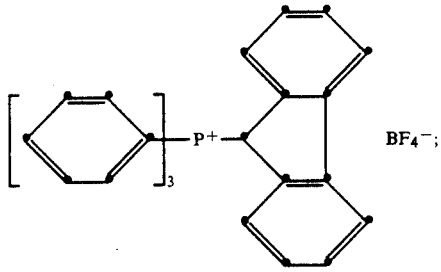

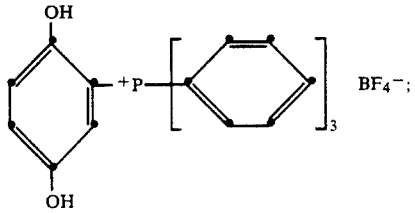

-continued
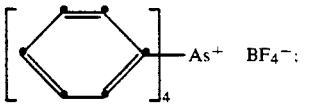
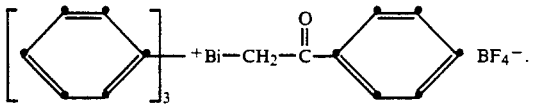
A representative portion of useful Group VIa onium salts, including sulfonium and selenonium salts, are:
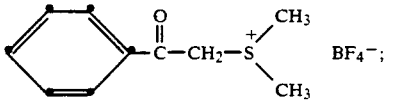
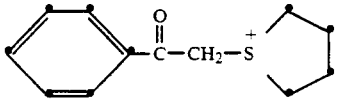
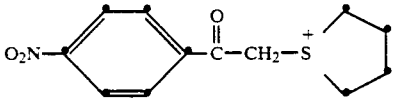
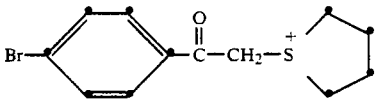
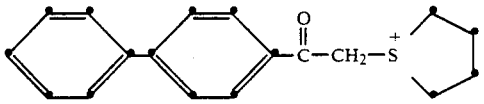
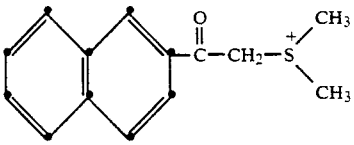
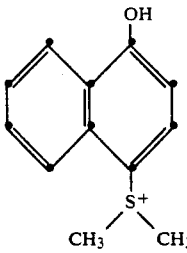
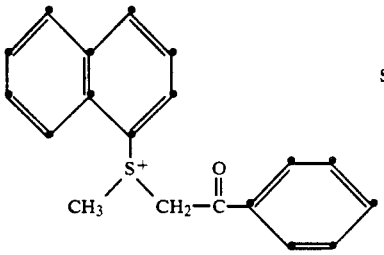
-continued
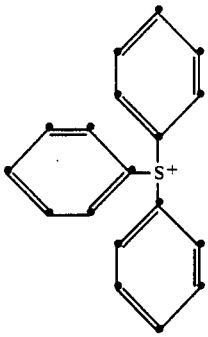
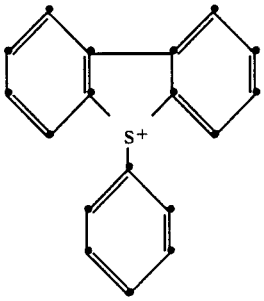
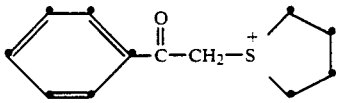
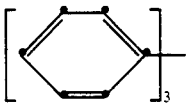
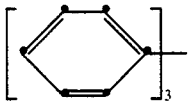
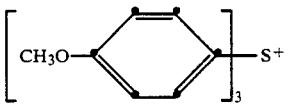
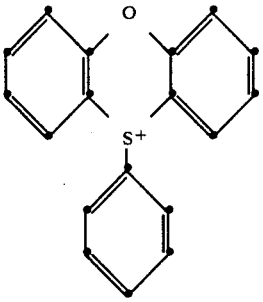
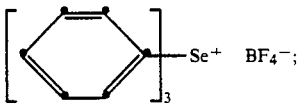

-continued

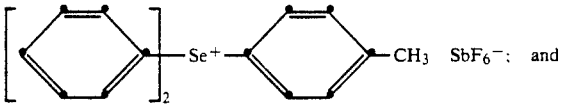

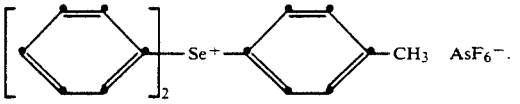

A representative portion of the useful Group VIIa onium salts, including iodonium salts, are the following:

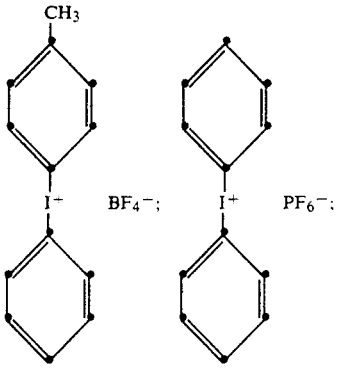

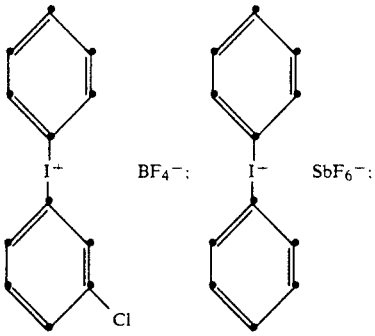

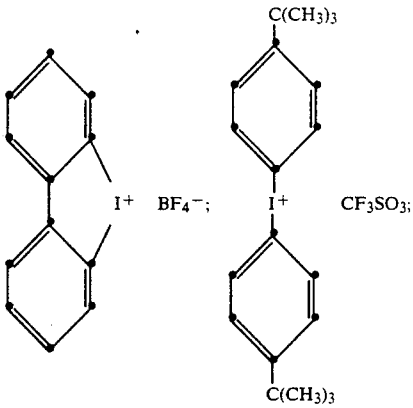

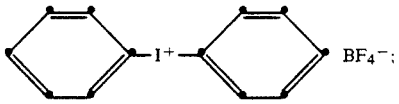

-continued

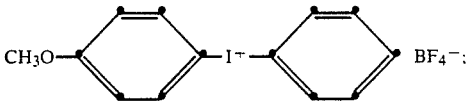

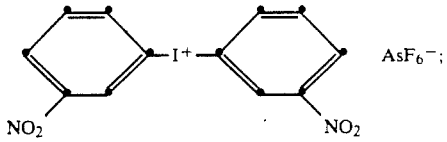

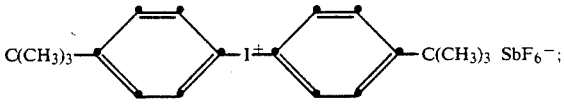

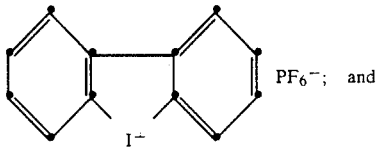

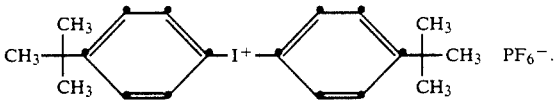

Also useful as acid photogenerating compounds are:

1. Aryldiazonium salts such as disclosed in U.S. Pat. Nos. 3,205,157; 3,711,396; 3,816,281; 3,817,840 and 3,829,369. The following salts are representative:

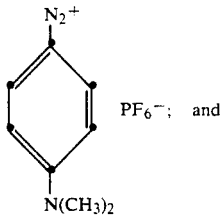

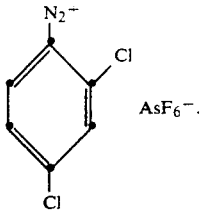

2. 6-Substituted-2,4-bis(trichloromethyl)-5-triazines such as disclosed in British Patent No. 1,388,492. The following compounds are representative:

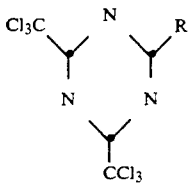

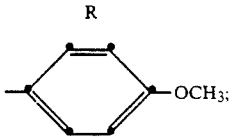

-continued

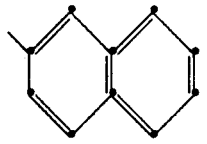

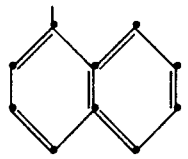

and

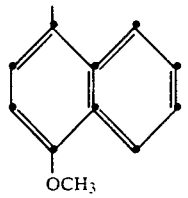

A particularly preferred class of acid photogenerators are the diaryliodonium salts and triarylsulfonium salts. For example, di-(4-t-butylphenyl)iodonium trifluoromethanesulfonate and triphenylsulfonium hexafluorophosphate have shown particular utility.

If the acid photogenerating compound is present in the dye-donor element, the concentration of the acid photogenerating compound should be sufficient to bleach the near-infrared sensitizer substantially or completely when the element is exposed to activating radiation. This concentration will generally be in the range of 1.0 to 30 percent of the dye-donor element, not including the support.

If the near-infrared absorbing sensitizer and acid photogenerating compound are included as a separate thin layer adjacent to the dye layer, a film-forming binder may be included in addition to the near-infrared absorbing sensitizer, and the acid-photogenerating compound. Suitable binders for this purpose include polycarbonates, polyesters, styrenics, methacrylic acid ester copolymers, vinyl chlorides, cellulose derivatives (such as cellulose acetate, cellulose butyrate and nitrocellulose), alkyds, polyurethanes, styrene-butadiene copolymers, silicone resins, styrene-alkyd resins, soya-alkyd resins, poly(vinyl chloride), poly(vinylidene chloride), vinylidene chloride, acrylonitrile copolymers, poly(vinyl acetate), vinyl acetate, vinyl chloride copolymers, poly(vinyl acetals) (such as poly(vinly butyral)), polyacrylic esters (such as poly(methyl methacrylate), poly(n-butyl methacrylate), poly(isobutyl methacrylate), etc.), polystyrene, nitrated polystyrene, poly(vinylphenol) polymethylstyrene, or isobutylene polymers.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS ® (Sumitomo Chemical Co., Ltd.), Dianix Fast Violet 3R-FS ® (Mitsubishi Chemical Industries, Ltd.), and Kayalon Polyol Brilliant Blue N-BGM ® and KST Black 146 ® (Nippon Kayaku Co., Ltd.); azo dyes such as Kayalon Polyol Brilliant Blue BM ®, Kayalon Polyol Dark Blue 2BM ®, and KST Black KR ® (Nippon Kayaku Co., Ltd.), Sumickaron Diazo Black 5G ® (Sumitomo Chemical Co., Ltd.), and Miktazol Black 5GH ® (Mitsui Toatsu Chemicals, Inc.); direct dyes such as Direct Dark Green B ® (Mitsubishi Chemical Industries, Ltd.) and Direct Brown M ® and Direct Fast Black D ® (Nippon Kayaku Co., Ltd.); acid dyes such as Kayanol Milling Cyanine 5R ® (Nippon kayaku Co., Ltd.); basic dyes such as Sumicacryl Blue 6G ® (Sumitomo Chemical Co., Ltd.), and Aizen Malachite Green ® (Hodogaya Chemical Co., Ltd.); and

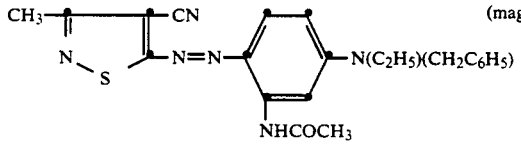

(magenta)

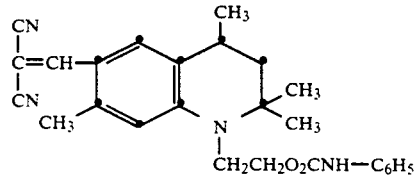

(yellow)

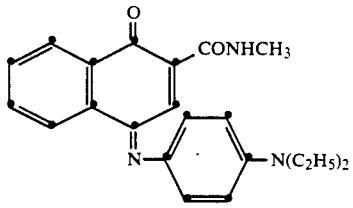

(cyan)

or any of the dyes disclosed in U.S. Pat. No. 4,541,830, the disclosure of which is hereby incorporated by reference. The above dyes may be employed singly or in combination to obtain a monochrome. Preferably, the dyes employed are hydrophobic. The dyes may be used in a concentration of about 0.01 to about 20 weight percent of the dye-donor element, not including the support.

The dye in the dye-donor element is dispersed in a polymeric binder such as a cellulose derivative (e.g., cellulose acetate hydrogen phthalate, cellulose acetate, cellulose acetate propionate, cellulose acetate butyrate, cellulose tricetate), a polycarbonate, poly(styrene-co-acrylonitrile), a poly(sulfone) or a poly(Phenylene oxide). The binder may be used in a concentration of about 40 weight percent to about 99 weight percent of the dye-donor element.

The dye layer of the dye-donor element may be coated on the support or printed by a printing technique such as a gravure process.

Any material can be used as the support for the dye-donor element of the invention provided it is dimensionally stable and can withstand the heat generated by the laser beam. Such materials are: polyesters such as poly(ethylene terephthalate); polyamides; Polycarbonates; glassine paper, condenser paper; cellulose esters such as cellulose acetate; fluorine polymers such as polyvinylidene fluoride or poly(tetrafluoroethlyene-co-hexafluoropropylene); polyethers such as polyoxymethylene; polyacetals; polyolefins such as polystyrene, polyethylene, polypropylene or methylpentane polymers. The support generally has a thickness of from about 2 to 250 μm. It may also be coated with a subbing layer, if desired.

Spacer beads, i.e. matte beads, may be employed in a separate layer over the dye layer in order to separate the dye-donor element from the dye receiver element to increase the uniformity and density of dye transfer. The use of spacer beads for this purpose is more fully described in U.S. Pat. No. 4,772,582. The spacer beads may be coated with a polymeric binder if desired.

The dye-receiver element that is used with the dye-donor element of the invention usually comprises a support and a dye image receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic Paper such as duPont Tyvek ®.

The dye image receiving layer may comprise, for example, a polycarbonate, a polyurethane, a polyester, polyvinyl chloride, poly(styrene-co-acrylonitrile), poly(caprolactone) or mixtures thereof. The dye image receiving layer may be present in any thickness which is effective for the intended purpose. In general, good results have been obtained at a thickness of from about 10 μm about 200 μm, preferably about 10 μm to about 50 μm.

The acid-photogenerating compound may be included in the dye-receiver element (either instead of or in addition to including the acid photogenerator in the dye-donor element). If present in the dye-receiver element, the acid-photogenerator is placed in the dye image receiving layer. The concentration of the acid-photogenerator required in the dye-receiver element depends on the near-infrared sensitizer used, the thickness of the dye-receiver layer, and the acid photogenerating compound used. Generally the acid-photogenerator may be present in the dye image receiving layer in a concentration of about 1.0 to about 30 weight percent.

As described above, the elements of the present invention may be used to form dye transfer images. One method of forming these images utilizes a dye-donor element comprising a heat-transferable dye, a bleachable and heat-transferable near-infrared radiation absorbing sensitizer, and an acid-photogenerating compound. In this method, the dye-donor element is exposed with near-infrared radiation. The near-infrared radiation is absorbed and converted to heat by the near-infrared absorbing sensitizer. The heat raises the temperature of the dye in the exposed areas to its vaporization temperature causing a volatilized, laser-induced thermal dye image to be formed on the dye-receiver element. Additionally, the near-infrared absorbing sensitizer is bleached upon exposure (concurrent with the image formation), thus eliminating the possibility of transfer of unwanted visible light absorption.

Upon volatilization, the laser-induced thermal dye image is transferred to a dye-receiver element. The dye-receiver must be positioned such that the dye-receiver element may receive the volatilized dye image from the dye-donor element. As noted above, spacer beads may be used to improve the quality of the image transfer.

The dye-donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651; 4,695,287; 4,701,439; 4,757,046; 4,743,582; 4,769,360; and 4,753,922, the disclosures of which are hereby incorporated by reference. Thus, one-, two-, three- or four-color elements (or higher) are included within the scope of the invention.

In a preferred embodiment of the invention, the dye-donor element comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Several kinds of lasers could conceivably be used to effect the thermal transfer of dye from a donor sheet to a receiver, such as ion gas lasers like argon and krypton; metal vapor lasers such as copper, gold, and cadmium; solid state lasers such as ruby or YAG; or diode lasers such as gallium arsenide emitting in the infrared region from 750 to 870 nm. However, in practice, the diode lasers offer substantial advantages in terms of their small size, low cost, stability, reliability, ruggedness, and ease of modulation.

Lasers which can be used to transfer dye from the dye-donor elements of the invention are also available commercially. Examples include Laser Model SDL-2420-H ® from Spectra Diode Labs. or Laser Model SLD 304 V/W ® from Sony Corp.

Although the method outlined above will result in transfer images with greatly reduced unwanted visible light absorptions, further exposure of the transferred image with near-infrared or near-ultraviolet radiation will bleach the unwanted absorptions to an even greater extent. To facilitate bleaching from exposure to near-ultraviolet radiation, a near-ultraviolet absorbing sensitizer may be added to the dye-receiver element. The amount of sensitizer used varies widely, depending on the type of near-infrared sensitizer used, the acid-photogenerating compound used, the thickness of the dye receiver layer, and the particular near-ultraviolet sensitizer used. Generally, the near-ultraviolet sensitizer may be present in a concentration of about 1.0 to about 10 weight percent of the dye image receiving layer.

Iodonium salt acid-photogenerators may be sensitized with ketones such as xanthones, indandiones, indanones, thioxanthones, acetophenones, benzophenones, or other aromatic compounds such as anthracenes, dialkoxyanthracenes, perylenes, phenothiazines, etc.

Another embodiment of the present invention utilizes the acid-photogenerating compound in the dye-receiver element. In this method, the dye-donor element, comprising a heat-transferable dye and a bleachable, heat-transferable, near-infrared radiation absorbing sensitizer, is exposed to near-infrared radiation. The near-infrared radiation is absorbed and converted to heat which volatilizes the dye in the exposed areas of the dye-donor element.

Upon volatilization, the laser-induced dye image, including the near-infrared absorbing sensitizer, is transferred to a dye-receiver element comprising an acid-photogenerating compound, a dye image receiving layer and a support. Unwanted visible light absorptions are then eliminated by exposure of the dye-receiver element to near-infrared radiation.

Alternatively, the dye-receiver element may be exposed with near-ultraviolet radiation to bleach any unwanted visible light absorptions by the near-infrared absorbing sensitizer. The addition of a near-ultraviolet absorbing sensitizer to the dye-receiver element will result in more effective bleaching of the near-infrared absorbing sensitizer.

The present invention is further illustrated by the following examples.

EXAMPLES

In the examples which follow, the preparation and characterization of representative materials and formulations are described. These examples are provided to illustrate the usefulness of the compositions of the present invention and are by no means intended to exclude the use of other compositions which fall within the above disclosure.

EXAMPLE 1

A thin film comprising 25 weight percent ("wt %") di-(t-butylphenyl)iodonium triflate ("ITf") as the acid-photogenerator, 5 wt % 9,10-diethoxyanthracene ("DEA") as the near-ultraviolet sensitizer, 3 wt % 3,3'-diethylthiatricarbocyanine iodide ("DTTC") as the near-infrared dye, and 67 wt % poly(vinyl benzoate-co-vinylacetate) in a 88/12 molar ratio ("PVBzAc") as a polymeric binder, is coated over a transparent support of polyethylene terephthalate by a machine coating technique. The film appears pale green as-coated, and photomicroscopy of a cross-section shows the film to be 2.8 μm thick. Spectroscopy shows strong absorption from 600 to 850 nm, which displays a maximum absorption at 781 nm with an optical density ("OD") of greater than 2.5. The film also displays several absorption maxima between 350 and 410 nm due to the near-UV sensitizer (DEA).

A portion of the film was exposed to near-ultraviolet light from a 500 watt mercury arc source for 90 seconds, for a total exposure of about 2.7 joules/cm$^2$. The pale green color was completely faded, and spectroscopy showed an OD of less than 0.10 at wavelengths greater than 600 nm.

Another portion of the film was exposed on a breadboard equipped with a 200 mW near-infrared laser diode (827 nm output), and the output beam focused to a 30 μm spot. The breadboard consists of a rotating drum, upon which the film is mounted, and a translation stage which moves the laser beam along the drum length. The drum rotation, the laser beam location, and the laser beam intensity are all controlled by an IBM-AT computer. The drum was rotated at a speed of 120 rpm, and the film was exposed to an electronically generated graduated exposure consisting of 11 exposure steps. The line spacing (distance between scan lines in the continuous tone step-wedge) was 20 μm, and the maximum intensity was about 100 mW with an exposure time of about 30 μsec/pixel.

The step-wedge thus produced appeared lightly rust-colored in the areas of maximum exposure, and six density steps in the wedge were clearly visible. Spectroscopy of an area which had received maximum exposure revealed an OD of 0.41 at 780 nm compared to an OD of greater than 2.5 at 780 nm of an adjacent, unexposed area. The exposed sample also displayed a second absorption maximum near 550 nm with an OD of 0.29. When this sample was further exposed with near-ultraviolet light on a breadboard in the manner described above, the rust color completely faded, and spectroscopy showed an OD of less than of 0.13 at wavelengths greater than 600 nm, and an OD of 0.20 OD at 550 nm.

These results indicate that subsequent bleaching with ultraviolet exposure is possible.

EXAMPLE 2

A film similar to that described in Example 1 is also coated, except that no near-ultraviolet absorbing sensitizer is added. The ratios of the components are 25 wt % TF, 3 wt % DTTC, and 72 wt % PvBzAc. The thickness of the recording layer is 7.4 μm, and the OD at 780 nm is greater than 4.0. After exposure to near-ultraviolet radiation, as described in Example 1, the OD at 780 nm is 1.42. A second maximum is observed with an OD of 0.46 at 545 nm. These results indicate that a near-ultraviolet sensitizer is preferred for efficient bleaching with near-ultraviolet radiation.

A second portion of this film is exposed on the laser breadboard in the same manner as described in Example 1. Six clear density steps are visible. The areas which receive maximum exposure are rust-colored, and spectroscopy of these areas reveals absorption maxima at 545 nm (OD of 0.43) and 775 nm (OD of 0.63). These results indicate that the near-ultraviolet absorbing sensitizer is not required for bleaching concurrent with near-infrared exposure.

EXAMPLE 3

Another film is coated in the same manner as described in Example 1, except that no acid-photogenerating compound is included. The weight ratios of the components are 5% DEA, 3% DTTC, and 92% PVBzAc. The film is 3.2 μm thick and displayed an absorption maximum at 785 nm (OD=1.29). After exposure with near-ultraviolet radiation, as described above, the OD at 785 nm is found to be 0.83. Near-infrared exposure on the laser breadboard results in no visible change in density or hue. Spectroscopy of an area which had received maximum exposure shows virtually no difference when compared to an adjacent, unexposed area. Thus, for significant bleaching to occur with either near-infrared or near-ultraviolet radiation, an acid-photogenerating compound must be present.

EXAMPLE 4

Several film samples are coated as described in Example 1, except that the acid-photogenerating compounds are varied. Accompanying Table I lists the varying acid-photogenerating compounds and their respective bleaching efficiency as a function of both near-ultraviolet and near-infrared exposure. Film thicknesses range between 8 and 11 μm. The samples are exposed in the same manner as described in Example 1. In Table I, bleaching efficiency is defined as:

$$1 - \left[ \frac{OD \text{ @ } 700 \text{ nm (exposed)}}{OD \text{ @ } 700 \text{ nm (unexposed)}} \right]$$

The OD at 700 nm was chosen as the reference point because many of the films display ODs that are off the scale at the 780 nm absorption maximum.

TABLE I

| ACID-GENERATOR | BLEACHING-EFFICIENCY NEAR-UV | NEAR-IR |
|---|---|---|
| di-(4-t-butylphenyl)-iodonium trifluoromethanesulfonate | 0.80 | 0.82 |
| di-(4-t-butylphenyl)-iodonium hexafluorophosphate | 0.91 | 0.76 |
| di-(4-t-butylphenyl)-iodonium p-toluenesulfonate | 0.36 | 0.43 |
| di-(4-t-butylphenyl)-iodonium perfluorobutyrate | 0.51 | 0.33 |
| triphenylsulfonium hexafluorophosphate | 0.92 | 0.14 |
| triphenylsulfonium hexafluoroantimonate | 0.83 | 0.13 |
| None (control) | 0.34 | 0.15 |

These results indicate that while iodonium salt acid photogenerators result in similar bleaching efficiency with either near-infrared or near-ultraviolet exposure, sulfonium salt acid photogenerators favor near-ultraviolet exposure. Thus, for applications in which stability of the near-infrared absorbing sensitizer to near-infrared radiation is important, but subsequent bleaching of any unwanted visible absorptions in the dye-receiver element is still required, a combination of a sulfonium salt acid photogenerator and a near-ultraviolet sensitizer in the dye-receiver element may be preferred.

Although the invention has been described in detail for the purpose of illustration, it is understood that such detail is solely for that purpose, and variations can be made therein by those skilled in the art without departing from the spirit and scope of the invention which is defined by the following claims.

What is claimed:

1. A method for forming a laser-induced thermal dye transfer image with a dye-donor element comprising a heat-transferable dye;

a bleachable, near-infrared radiation absorbing sensitizer; and an acid photogenerating compound; wherein said method comprises the steps of exposing the dye-donor element with near-infrared radiation to heat exposed areas of said element, whereby exposed portions of said element are volatilized as a laser-induced thermal dye image and said near-infrared absorbing sensitizer is bleached to eliminate unwanted visible light absorptions and transferring said laser-induced thermal dye image to a dye-receiver element.

2. The method of claim 1, wherein said near-infrared radiation absorbing sensitizer is chosen from the group consisting of cyanine compounds.

3. The method of claim 2, wherein said cyanine compound is chosen from the group consisting of 3,3'-diethylthiatricarbocy anine and 1,1'-diethyl-4,4'-carbocyanine iodide.

4. The method of claim 1, where said acid-photogenerating compound is an aromatic onium salt selected from the group consisting of aryl halonium salts, aryl phosphonium salts, aryl arsenonium salts, aryl sulfonium salts, aryl selenonium salts, aryl diazonium salts, aryl iodonium salts and mixtures thereof.

5. A method for forming a laser-induced thermal dye transfer image with a dye-donor element comprising:

a heat transferable dye and a bleachable, heat-transferable, near-infrared radiation absorbing sensitizer;

wherein said method comprises the steps of exposing the dye-donor element with near-infrared radiation to heat exposed areas of said element, whereby exposed portions of said element are volatilized as a laser-induced dye image;

transferring said laser-induced dye image to a dye-receiver element comprising a dye image receiving layer and an acid-photogenerating compound; and exposing said laser-induced dye image to activating radiation to effect bleaching of said near-infrared radiation absorbing sensitizer.

6. The method of claim 5, wherein said activating radiation is near-infrared radiation.

7. The method of claim 5, wherein said dye-receiver element further comprises a near-ultraviolet absorbing sensitizer.

8. The method of claim 7, wherein said activating radiation is near-ultraviolet radiation.

9. A thermal dye transfer assemblage comprising a dye-donor element comprising a heat-transferable dye and a bleachable, near-infrared radiation absorbing sensitizer; and a dye-receiver element positioned to receive a laser-induced dye image from said dye-donor element and comprising a dye image receiving layer, wherein said thermal dye transfer assemblage contains an acid-photogenerating compound in either said dye-donor element or said dye-receiver element.

10. The assemblage of claim 9, wherein said acid-photogenerating compound is in said dye-donor

11. The assemblage of claim 9, wherein said acid-photogenerating compound is in said dye-receiver element.

12. The assemblage of claim 9, wherein said near-infrared radiation absorbing sensitizer is chosen from the group consisting of the cyanine compounds.

13. The assemblage of claim 12, wherein said cyanine compound is chosen from the group consisting of 3,3'-diethylthiatricarbocyanine and 1,1'-diethyl-4,4'-carbocyanine iodide.

14. The assemblage of claim 9, wherein said acid-photogenerating compound is an aromatic onium salt selected from the group consisting of aryl halonium salts, aryl phosphonium salts, aryl arsenonium salts, aryl sulfonium salts, aryl selenonium salts, aryl diazonium salts, aryl iodonium salts and mixtures thereof.

15. The assemblage of claim 9 further comprising:

a near-ultraviolet radiation absorbing sensitizer in either said dye-donor element or said dye-receiver element.

16. The assemblage of claim 15, wherein said near-ultraviolet radiation absorbing sensitizer is chosen from the group consisting of xanthones, indandiones, indanones, throxanthones, acetophenones, benzophenones, anthracenes, dialkoxyanthracenes, perylenes, phenothiazines, and pyrenes.

17. A dye-donor element for laser-induced thermal dye transfer comprising a non-bleachable, heat-transferable dye;

a bleachable, heat-transferable, near-infrared radiation absorbing sensitizer; and an acid-photogenerating compound.

* * * * *